US009293828B2

(12) United States Patent
Bevelacqua et al.

(10) Patent No.: US 9,293,828 B2
(45) **Date of Patent: *Mar. 22, 2016**

(54) ANTENNA SYSTEM WITH TUNING FROM COUPLED ANTENNA

(71) Applicant: Apple Inc., Cupertino, CA (US)

(72) Inventors: Peter Bevelacqua, San Jose, CA (US); Hao Xu, Cupertino, CA (US); Jayesh Nath, Milpitas, CA (US); Jennifer M. Edwards, San Francisco, CA (US); Mattia Pascolini, Campbell, CA (US)

(73) Assignee: Apple Inc., Cupertino, CA (US)

( * ) Notice: Subject to any disclaimer, the term of this patent is extended or adjusted under 35 U.S.C. 154(b) by 380 days.

This patent is subject to a terminal disclaimer.

(21) Appl. No.: 13/851,471

(22) Filed: Mar. 27, 2013

(65) Prior Publication Data

US 2014/0292598 A1 Oct. 2, 2014

(51) Int. Cl.

| | |
|---|---|
| ***H01Q 9/04*** | (2006.01) |
| ***H01Q 5/378*** | (2015.01) |
| *H01Q 5/392* | (2015.01) |
| *H01Q 1/22* | (2006.01) |
| *H01Q 9/42* | (2006.01) |
| *H01Q 5/371* | (2015.01) |

(52) U.S. Cl.

CPC ..... *H01Q 9/0442* (2013.01); *H01Q 5/378* (2015.01); *H01Q 1/2266* (2013.01); *H01Q 5/371* (2015.01); *H01Q 5/392* (2015.01); *H01Q 9/42* (2013.01)

(58) Field of Classification Search

CPC ..... H01Q 5/392; H01Q 5/378

See application file for complete search history.

(56) References Cited

U.S. PATENT DOCUMENTS

| | | | |
|---|---|---|---|
| 5,832,372 | A | 11/1998 | Clelland et al. |
| 6,034,636 | A | 3/2000 | Saitoh |
| 6,317,094 | B1 | 11/2001 | Wu et al. |

(Continued)

FOREIGN PATENT DOCUMENTS

| | | |
|---|---|---|
| EP | 0892459 | 1/1999 |
| EP | 1146590 | 10/2001 |

(Continued)

OTHER PUBLICATIONS

Nickel et al., U.S. Appl. No. 12/752,966, filed Apr. 1, 2010.

(Continued)

*Primary Examiner* — Hoang V Nguyen
*Assistant Examiner* — Michael Bouizza
(74) *Attorney, Agent, or Firm* — Treyz Law Group, P.C.; G. Victor Treyz; Michael H. Lyons

(57) ABSTRACT

Electronic devices may include radio-frequency transceiver circuitry and antenna structures. The antenna structures may form a dual arm inverted-F antenna and an additional antenna such as a monopole antenna sharing a common antenna ground. The antenna structures may have three ports. A first antenna port may be coupled to an inverted-F antenna resonating element at a first location and a second antenna port may be coupled to the inverted-F antenna resonating element at a second location. A third antenna port may be coupled to the additional antenna. An adjustable component may be coupled to the first antenna port to tune the inverted-F antenna. The inverted-F antenna may be near-field coupled to the additional antenna so that the inverted-F antenna may serve as a tunable parasitic antenna resonating element that tunes the additional antenna.

22 Claims, 7 Drawing Sheets

(56) References Cited

U.S. PATENT DOCUMENTS

| | | | | |
|---|---|---|---|---|
| 6,414,641 | B1 | 7/2002 | Carlson et al. | |
| 6,423,915 | B1 | 7/2002 | Winter | |
| 6,498,586 | B2 | 12/2002 | Pankinaho | |
| 6,504,507 | B2 | 1/2003 | Geeraert | |
| 6,650,295 | B2 | 11/2003 | Ollikainen et al. | |
| 6,714,162 | B1 | 3/2004 | Kadambi et al. | |
| 6,734,825 | B1 | 5/2004 | Guo et al. | |
| 6,762,723 | B2 | 7/2004 | Nallo et al. | |
| 6,762,729 | B2 | 7/2004 | Egashira | |
| 6,836,249 | B2 | 12/2004 | Kenoun et al. | |
| 6,917,335 | B2 | 7/2005 | Kadambi et al. | |
| 6,933,893 | B2 | 8/2005 | Rubindhteyn et al. | |
| 6,950,065 | B2 | 9/2005 | Ying et al. | |
| 6,970,137 | B1 | 11/2005 | Maslovski et al. | |
| 7,075,493 | B2 | 7/2006 | Azadegan et al. | |
| 7,079,079 | B2 | 7/2006 | Jo et al. | |
| 7,145,513 | B1 | 12/2006 | Cohen | |
| 7,183,982 | B2 | 2/2007 | Kadambi et al. | |
| 7,408,515 | B2 | 8/2008 | Leisten | |
| 7,551,142 | B1 | 6/2009 | Zhang et al. | |
| 7,671,804 | B2 | 3/2010 | Zhang et al. | |
| 7,812,774 | B2 | 10/2010 | Friman et al. | |
| 7,889,143 | B2 | 2/2011 | Milosavljevic et al. | |
| 7,924,226 | B2 | 4/2011 | Soler Castany et al. | |
| 8,063,827 | B2 | 11/2011 | Hotta et al. | |
| 8,111,640 | B2 | 2/2012 | Knox | |
| 8,270,914 | B2 | 9/2012 | Pascolini et al. | |
| 2004/0140933 | A1 | 7/2004 | Shikata et al. | |
| 2005/0151689 | A1 | 7/2005 | Vesterinen | |
| 2005/0280587 | A1 | 12/2005 | Svigelj et al. | |
| 2007/0008222 | A1* | 1/2007 | Wang et al. | 343/700 MS |
| 2008/0055164 | A1 | 3/2008 | Zhang et al. | |
| 2008/0278379 | A1* | 11/2008 | Wang et al. | 343/700 MS |
| 2009/0051611 | A1* | 2/2009 | Shamblin et al. | 343/747 |
| 2010/0231470 | A1 | 9/2010 | Lee et al. | |
| 2010/0279734 | A1 | 11/2010 | Karkinen et al. | |
| 2011/0102290 | A1 | 5/2011 | Milosavljevic | |
| 2011/0188552 | A1 | 8/2011 | Yoon et al. | |
| 2011/0312393 | A1* | 12/2011 | Pulimi et al. | 343/833 |
| 2011/0316751 | A1* | 12/2011 | Jarvis et al. | 343/702 |
| 2012/0009983 | A1* | 1/2012 | Mow et al. | 343/745 |
| 2012/0112970 | A1 | 5/2012 | Caballero et al. | |
| 2012/0146865 | A1 | 6/2012 | Hayashi | |
| 2012/0169552 | A1 | 7/2012 | Lee et al. | |
| 2012/0176292 | A1 | 7/2012 | Hung et al. | |
| 2012/0229347 | A1 | 9/2012 | Jin | |
| 2012/0299785 | A1 | 11/2012 | Bevelacqua | |
| 2014/0266923 | A1 | 9/2014 | Zhou et al. | |

FOREIGN PATENT DOCUMENTS

| | | |
|---|---|---|
| EP | 1168496 | 1/2002 |
| EP | 1387435 | 2/2004 |
| EP | 1501154 | 4/2007 |
| EP | 2178167 | 4/2010 |
| EP | 2182577 | 5/2010 |
| EP | 2234207 | 9/2010 |
| WO | 01/29927 | 4/2001 |

OTHER PUBLICATIONS

Bevelacqua et al., U.S. Appl. No. 13/860,396, filed Apr. 10, 2013.
Vazquez et al., U.S. Appl. No. 13/889,987, filed May 8, 2013.
Hu et al., U.S. Appl. No. 13/890,013, filed May 8, 2013.
Bevelacqua et al., U.S. Appl. No. 13/851,471, filed Mar. 27, 2013.
Jin et al., U.S. Appl. No. 13/846,471, filed Mar. 18, 2013.
Ouyang et al., U.S. Appl. No. 13/846,459, filed Mar. 18, 2013.
Zhou et al., U.S. Appl. No. 13/846,481, filed Mar. 18, 2013.
Darnell et al., U.S. Appl. No. 13/368,855, filed Feb. 8, 2012.
Hu et al., U.S. Appl. No. 13/366,142, filed Feb. 3, 2012.
Pascolini et al., U.S. Appl. No. 13/343,657, filed Jan. 4, 2012.

* cited by examiner

ANTENNA SYSTEM WITH TUNING FROM COUPLED ANTENNA

BACKGROUND

This relates generally to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device may include radio-frequency transceiver circuitry and antenna structures. The antenna structures may have multiple antenna ports such as first, second, and third ports. The transceiver circuitry may include a satellite navigation system receiver, a wireless local area network transceiver, and a cellular transceiver for handling cellular voice and data traffic.

The antenna structures may include an inverted-F antenna resonating element that forms an inverted-F antenna with an antenna ground. The antenna structures may also include an additional antenna such as a monopole antenna resonating element.

An adjustable component may be coupled to the first antenna port to tune the inverted-F antenna. During operation of the inverted-F antenna, tuning may allow the inverted-F antenna to cover an expanded range of communications frequencies. The inverted-F antenna may be near-field coupled to the additional antenna so that the inverted-F antenna may serve as a tunable parasitic antenna resonating element that tunes the additional antenna during use of the additional antenna.

Further features of the invention, its nature and various advantages will be more apparent from the accompanying drawings and the following detailed description of the preferred embodiments.

DETAILED DESCRIPTION

Figure 1:
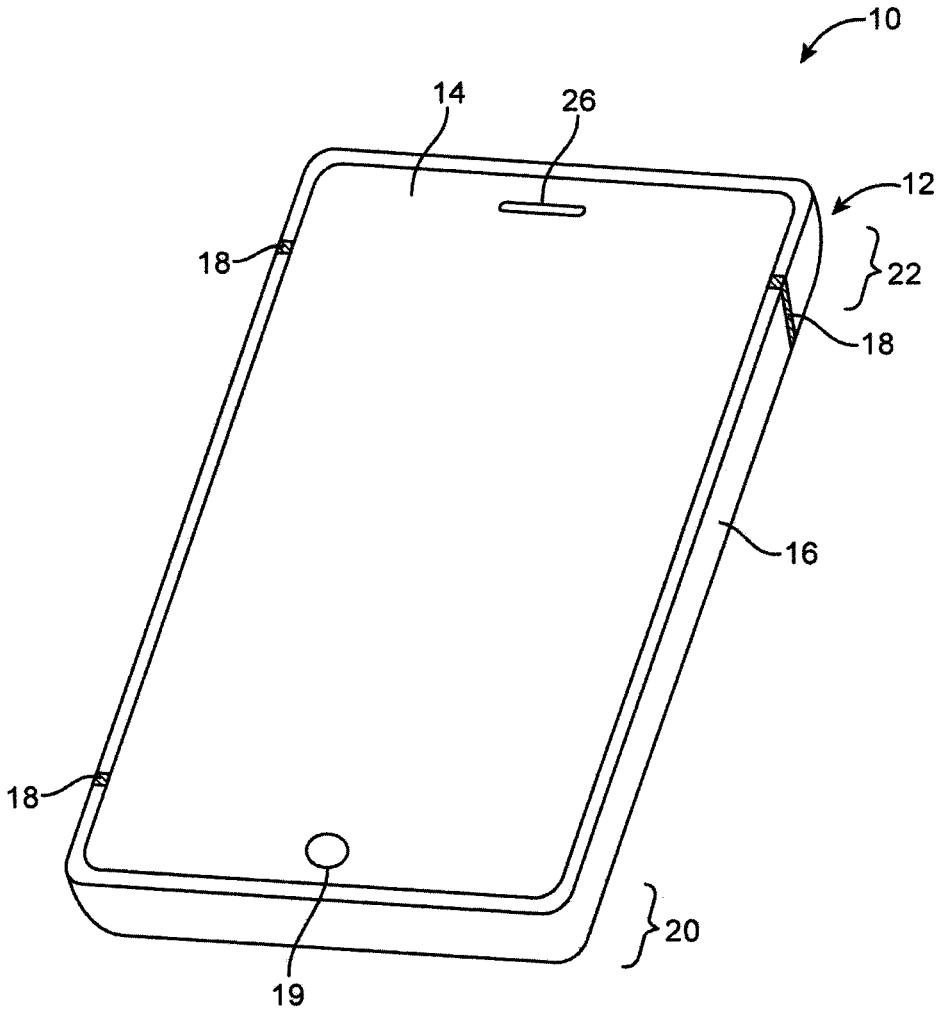
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps in the peripheral conductive member may be associated with the antennas.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic may cover the surface of display 14. Buttons such as button 19 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape, structures 16 may be implemented using a peripheral housing member have a rectangular ring shape (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures may be located in the center of housing 12 under display 14 (as an example).

In regions 22 and 20, openings may be formed within the conductive structures of device 10 (e.g., between peripheral conductive housing structures 16 and opposing conductive structures such as conductive housing midplate or rear housing wall structures, a conductive ground plane associated with a printed circuit board, and conductive electrical components in device 10). These openings, which may sometimes be referred to as gaps, may be filled with air, plastic, and other dielectrics. Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22.

In general, device 10 may include any suitable number of antennas (e.g., one or more, two or more, three or more, four or more, etc.). The antennas in device 10 may be located at opposing first and second ends of an elongated device housing, along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
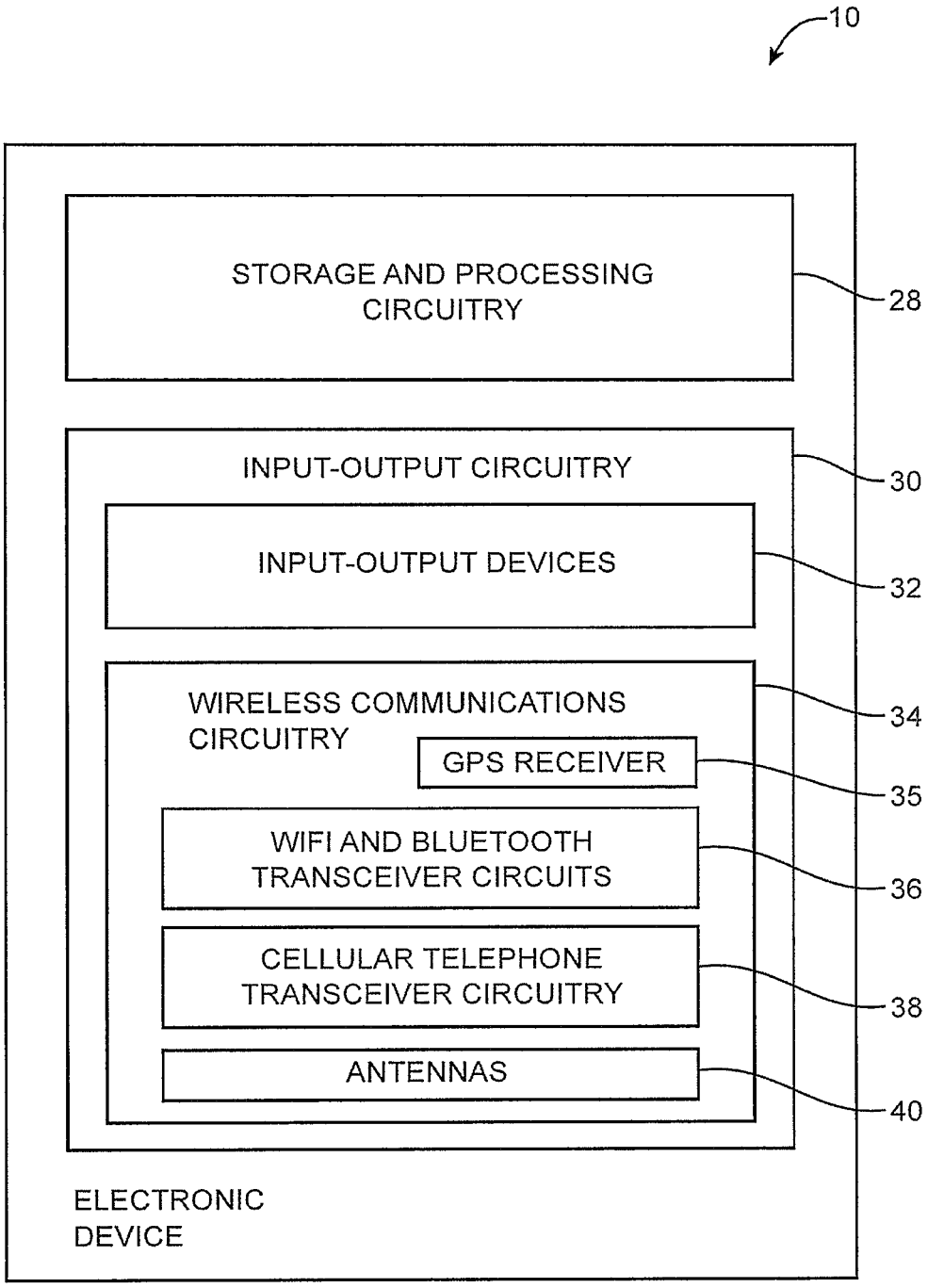
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas in device 10. For example, circuitry 28 may perform signal quality monitoring operations, sensor monitoring operations, and other data gathering operations and may, in response to the gathered data and information on which communications bands are to be used in device 10, control which antenna structures within device 10 are being used to receive and process data and/or may adjust one or more switches, tunable elements, or other adjustable circuits in device 10 to adjust antenna performance. As an example, circuitry 28 may control which of two or more antennas is being used to receive incoming radio-frequency signals, may control which of two or more antennas is being used to transmit radio-frequency signals, may control the process of routing incoming data streams over two or more antennas in device 10 in parallel, may tune an antenna to cover a desired communications band, etc.

In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, filters, duplexers, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Wireless local area network transceiver circuitry such as transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, etc. Near field communications may also be supported (e.g., at 13.56 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may have antenna structures such as one or more antennas 40. Antenna structures 40 may be formed using any suitable antenna types. For example, antenna structures 40 may include antennas with resonating elements that are formed from loop antenna structures, patch antenna structures, inverted-F antenna structures, dual arm inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link. Antenna structures in device 10 such as one or more of antennas 40 may be provided with one or more antenna feeds, fixed and/or adjustable components, and optional parasitic antenna resonating elements so that the antenna structures cover desired communications bands.

Figure 3:
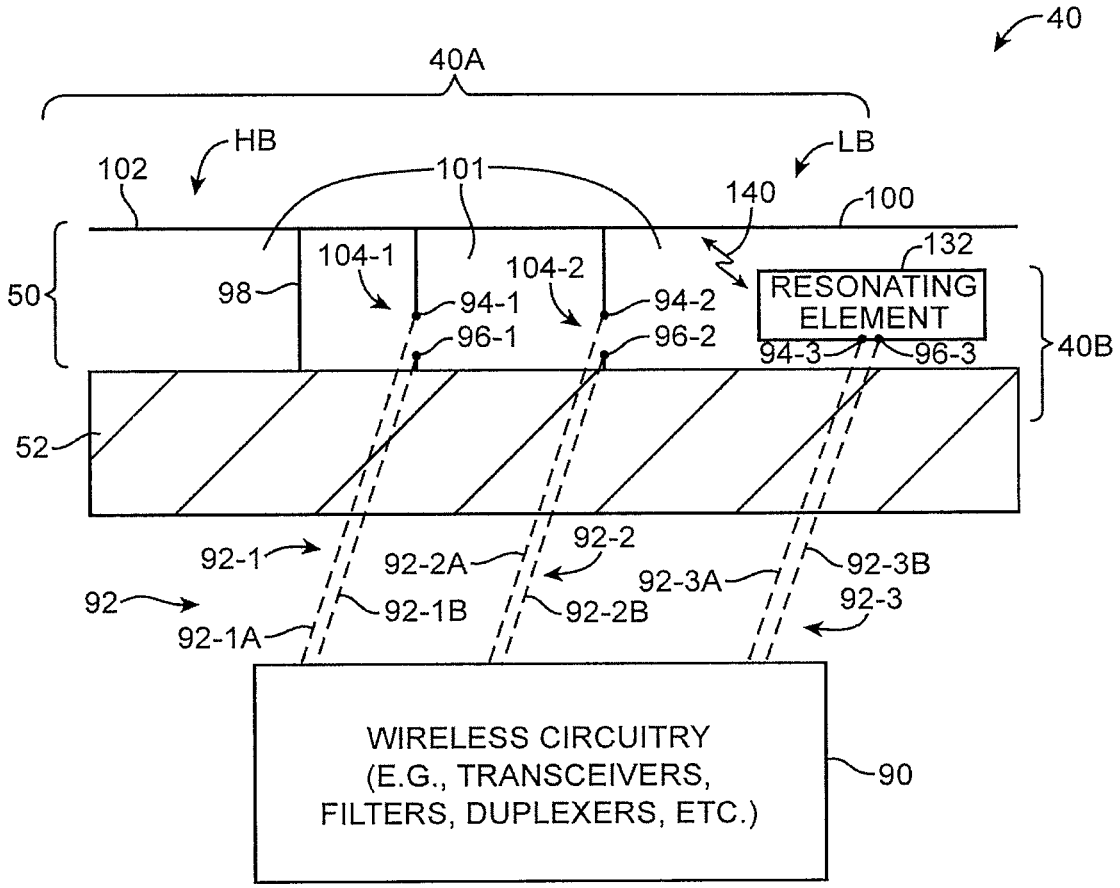
FIG. 3 is a diagram of an illustrative tunable antenna in accordance with an embodiment of the present invention.

Illustrative antenna structures of the type that may be used in device 10 (e.g., in region 20 and/or region 22) are shown in FIG. 3. Antenna structures 40 of FIG. 3 include an antenna resonating element of the type that is sometimes referred to as a dual arm inverted-F antenna resonating element or T antenna resonating element. As shown in FIG. 3, antenna structures 40 may have conductive antenna structures such as dual arm inverted-F antenna resonating element 50, additional antenna resonating element 132 (which may be near-field coupled to the dual-arm inverted-F antenna resonating element 50, as indicated by near-field electromagnetic signals 140 in FIG. 3), and antenna ground 52. The conductive structures that form antenna resonating element 50, antenna resonating element 132, and antenna ground 52 may be formed from parts of conductive housing structures, from parts of electrical device components in device 10, from printed circuit board traces, from strips of conductor such as strips of wire and metal foil, or may be formed using other conductive structures.

Antenna resonating element 50 and antenna ground 52 may form first antenna structures 40A (e.g., a first antenna such as a dual arm inverted-F antenna). Resonating element 132 and antenna ground 52 may form second antenna structures 40B (e.g., a second antenna). Antenna 40B may be a monopole antenna, an inverted-F antenna, a patch antenna, a loop antenna, a slot antenna, a hybrid antenna that is based on two or more different antennas such as these, or other suitable antenna structures.

As shown in FIG. 3, antenna structures 40 may be coupled to wireless circuitry 90 such as transceiver circuitry, filters, switches, duplexers, impedance matching circuitry, and other circuitry using transmission line structures such as transmission line structures 92. Transmission line structures 92 may include transmission lines such as transmission line 92-1, transmission line 92-2, and transmission line 92-3. Transmission line 92-1 may have positive signal path 92-1A and ground signal path 92-1B. Transmission line 92-2 may have positive signal path 92-2A and ground signal path 92-2B. Transmission line 92-3 may have positive signal path 92-3A and ground signal path 92-3B. Paths 92-1A, 92-1B, 92-2A, 92-2B, 92-3A, and 92-3B may be formed from metal traces on rigid printed circuit boards, may be formed from metal traces on flexible printed circuits, may be formed on dielectric support structures such as plastic, glass, and ceramic members, may be formed as part of a cable, or may be formed from other conductive signal lines. Transmission line structures 92 may be formed using one or more microstrip transmission lines, stripline transmission lines, edge coupled microstrip transmission lines, edge coupled stripline transmission lines, coaxial cables, or other suitable transmission line structures. Circuits such as impedance mating circuits, filters, switches, duplexers, diplexers, and other circuitry may, if desired, be interposed in the transmission lines of structures 92.

Transmission line structures 92 may be coupled to antenna ports formed using antenna port terminals 94-1 and 96-1 (which form a first antenna port), antenna port terminals 94-2 and 96-2 (which form a second antenna port), and antenna port terminals 94-3 and 96-3 (which form a third antenna port). The antenna ports may sometimes be referred to as antenna feeds. For example, terminal 94-1 may be a positive antenna feed terminal and terminal 96-1 may be a ground antenna feed terminal for a first antenna feed, terminal 94-2 may be a positive antenna feed terminal and terminal 96-2 may be a ground antenna feed terminal for a second antenna feed, and terminal 94-3 may be a positive antenna feed terminal and terminal 96-3 may be a ground antenna feed terminal for a third antenna feed.

Each antenna port in antenna structures 40 may be used in handling a different type of wireless signals. For example, the first port may be used for transmitting and/or receiving antenna signals in a first communications band or first set of communications bands, the second port may be used for transmitting and/or receiving antenna signals in a second communications band or second set of communications bands, and the third port may be used for transmitting and/or receiving antenna signals in a third communications band or third set of communications bands.

If desired, tunable components such as adjustable capacitors, adjustable inductors, filter circuitry, switches, impedance matching circuitry, duplexers, and other circuitry may be interposed within transmission line paths (i.e., between wireless circuitry 90 and the respective ports of antenna structures 40). The different ports in antenna structures 40 may each exhibit a different impedance and antenna resonance behavior as a function of operating frequency. Wireless circuitry 90 may therefore use different ports for different types of communications. As an example, signals associated with communicating in one or more cellular communications band may be transmitted and received using one of the ports, whereas reception of satellite navigation system signals may be handled using a different one of the ports.

Antenna resonating element 50 may include a short circuit branch such as branch 98 that couples resonating element arm structures such as arms 100 and 102 to antenna ground 52. Dielectric gap 101 separates arms 100 and 102 from antenna ground 52. Antenna ground 52 may be formed from housing structures such as a metal midplate member, printed circuit traces, metal portions of electronic components, or other conductive ground structures. Gap 101 may be formed by air, plastic, and other dielectric materials. Short circuit branch 98 may be implemented using a strip of metal, a metal trace on a dielectric support structure such as a printed circuit or plastic carrier, or other conductive path that bridges gap 101 between resonating element arm structures (e.g., arms 102 and/or 100) and antenna ground 52.

The antenna port formed from terminals 94-1 and 96-1 may be coupled in a path such as path 104-1 that bridges gap 101. The antenna port formed from terminals 94-2 and 96-2 may be coupled in a path such as path 104-2 that bridges gap 101 in parallel with path 104-1 and short circuit path 98.

Resonating element arms 100 and 102 may form respective arms in a dual arm inverted-F antenna resonating element. Arms 100 and 102 may have one or more bends. The illustrative arrangement of FIG. 3 in which arms 100 and 102 run parallel to ground 52 is merely illustrative.

Arm 100 may be a (longer) low-band arm that handles lower frequencies, whereas arm 102 may be a (shorter) high-band arm that handles higher frequencies. Low-band arm 100 may allow antenna 40 to exhibit an antenna resonance at low band (LB) frequencies such as frequencies from 700 MHz to 960 MHz or other suitable frequencies. High-band arm 102 may allow antenna 40 to exhibit one or more antenna resonances at high band (HB) frequencies such as resonances at one or more ranges of frequencies between 960 MHz to 2700 MHz or other suitable frequencies. Antenna resonating element 50 may also exhibit an antenna resonance at 1575 MHz or other suitable frequency for supporting satellite navigation system communications such as Global Positioning System communications.

Antenna resonating element 132 may be used to support communications at additional frequencies (e.g., frequencies associated with a 2.4 GHz communications band such as an IEEE 802.11 wireless local area network band, a 5 GHz communications band such as an IEEE 802.11 wireless local area network band, and/or cellular frequencies such as frequencies in cellular bands near 2.4 GHz).

Antenna resonating element 132 may be formed from strips of metal (e.g., stamped metal foil), metal traces on a flexible printed circuit (e.g., a printed circuit formed from a flexible substrate such as a layer of polyimide or a sheet of other polymer material), metal traces on a rigid printed circuit board substrate (e.g., a substrate formed from a layer of fiberglass-filled epoxy), metal traces on a plastic carrier, patterned metal on glass or ceramic support structures, wires, electronic device housing structures, metal parts of electrical components in device 10, or other conductive structures.

To provide antenna 40 with tuning capabilities, antenna 40 may include adjustable circuitry. The adjustable circuitry may be coupled between different locations on antenna resonating element 50, may be coupled between different locations on resonating element 132, may form part of paths such as paths 104-1 and 104-2 that bridge gap 101, may form part of transmission line structures 92 (e.g., circuitry interposed within one or more of the conductive lines in path 92-1, path 92-2, and/or path 92-3), or may be incorporated elsewhere in antenna structures 40, transmission line paths 92, and wireless circuitry 90.

The adjustable circuitry may be tuned using control signals from control circuitry 28 (FIG. 2). Control signals from control circuitry 28 may, for example, be provided to an adjustable capacitor, adjustable inductor, or other adjustable circuit using a control signal path that is coupled between control circuitry 28 and the adjustable circuit. Control circuitry 28 may provide control signals to adjust a capacitance exhibited by an adjustable capacitor, may provide control signals to adjust the inductance exhibited by an adjustable inductor, may provide control signals that adjust the impedance of a circuit that includes one or more components such fixed and variable capacitors, fixed and variable inductors, switching circuitry for switching electrical components such as capacitors and inductors into and out of use, resistors, and other adjustable circuitry, or may provide control signals to other adjustable circuitry for tuning the frequency response of antenna structures 40. As an example, antenna structures 40 may be provided with an adjustable capacitor such as adjustable capacitor 106 of FIG. 4. By selecting a desired capacitance value for adjustable capacitor 106 using control signals from control circuitry 28, antenna structures 40 can be tuned to cover operating frequencies of interest.

If desired, the adjustable circuitry of antenna structures 40 may include one or more adjustable circuits that are coupled to antenna resonating element structures 50 such as arms 102 and 100 in antenna resonating element 50, one or more adjustable circuits that are coupled to resonating element 132, one or more adjustable circuits that are interposed within the signal lines associated with one or more of the ports for antenna structures 40 (e.g., paths 104-1, 104-2, paths 92, etc.).

Figure 4:
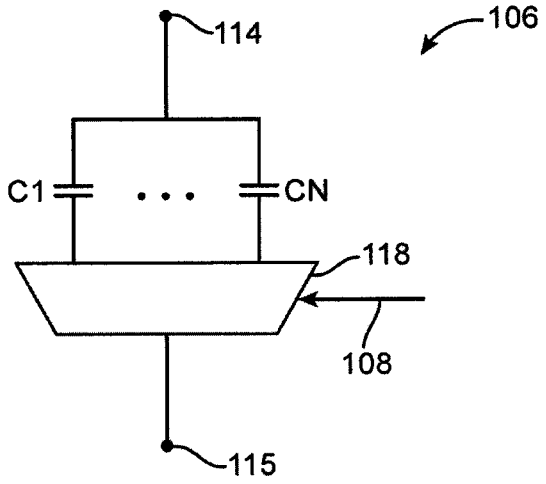
FIG. 4 is a diagram of an illustrative adjustable capacitor of the type that may be used in tuning antenna structures in an electronic device in accordance with an embodiment of the present invention.

Adjustable capacitor 106 of FIG. 4 produces an adjustable amount of capacitance between terminals 114 and 115 in response to control signals provided to input path 108. Switching circuitry 118 has N terminals coupled respectively to N capacitors C1 . . . CN and has another terminal coupled to terminal 115 of adjustable capacitor 106. The value of N may be larger than 1. For example, N may be two, three, two or more, three or more, six, more than six, or other suitable number. Capacitor C1 is coupled between terminal 114 and one of the terminals of switching circuitry 118. Additional capacitors C2 . . . CN are each coupled between terminal 114 and another respective terminal of switching circuitry 118 in parallel with capacitor C1. Switching circuitry 118 may include switches for switching capacitors into our out of use in adjustable capacitor 106. By controlling the value of the control signals supplied to control input 108, switching circuitry 118 may be configured to produce a desired capacitance value between terminals 114 and 115. For example, switching circuitry 118 may be configured to switch capacitor C1 into use while switching capacitors C2 . . . CN out of use, may be used to switch all capacitors C1 . . . CN into use simultaneously, may be used to switch all capacitors C1 . . . CN out of use simultaneously, or may be used to switch one or more other combinations of capacitors into use. With one illustrative configuration, the value of each capacitor may be about 0.4 pF and adjustable capacitor 106 may produce adjustable capacitor values ranging from 0 pF (all capacitors switched out of use) to 10 pF (all capacitors switched into use) depending on the setting of switch 118. A value of 0.4 pF may be achieved by switching one capacitor switched into use. Other intermediate values of capacitance can be implemented by switching other numbers of capacitors into use.

Switching circuitry 118 may include one or more switches or other switching resources that selectively decouple capacitors C1 . . . CN (e.g., by forming an open circuit so that the path between terminals 114 and 115 is an open circuit and all of capacitors C1 . . . CN are switched out of use). Switching circuitry 118 may also be configured (if desired) so that all capacitors C1 . . . CN are simultaneously switched into use. Other types of switching circuitry 118 such as switching circuitry that exhibits fewer switching states or more switching states may be used if desired. As an example, in a configuration in which N is equal to six, capacitor 106 may be configured to exhibit $2^6$ (64) different states and associated capacitance values. Adjustable capacitors such as adjustable capacitor 106 may also be implemented using variable capacitor devices (sometimes referred to as varactors).

During operation of device 10, control circuitry such as storage and processing circuitry 28 of FIG. 2 may make antenna adjustments by providing control signals to adjustable components such as one or more adjustable capacitors 106. If desired, control circuitry 28 may also make antenna tuning adjustments using adjustable inductors or other adjustable circuitry. Antenna frequency response adjustments may be made in real time in response to information identifying which communications bands are active, in response to feedback related to signal quality or other performance metrics, in response to sensor information, or based on other information.

Figure 5:
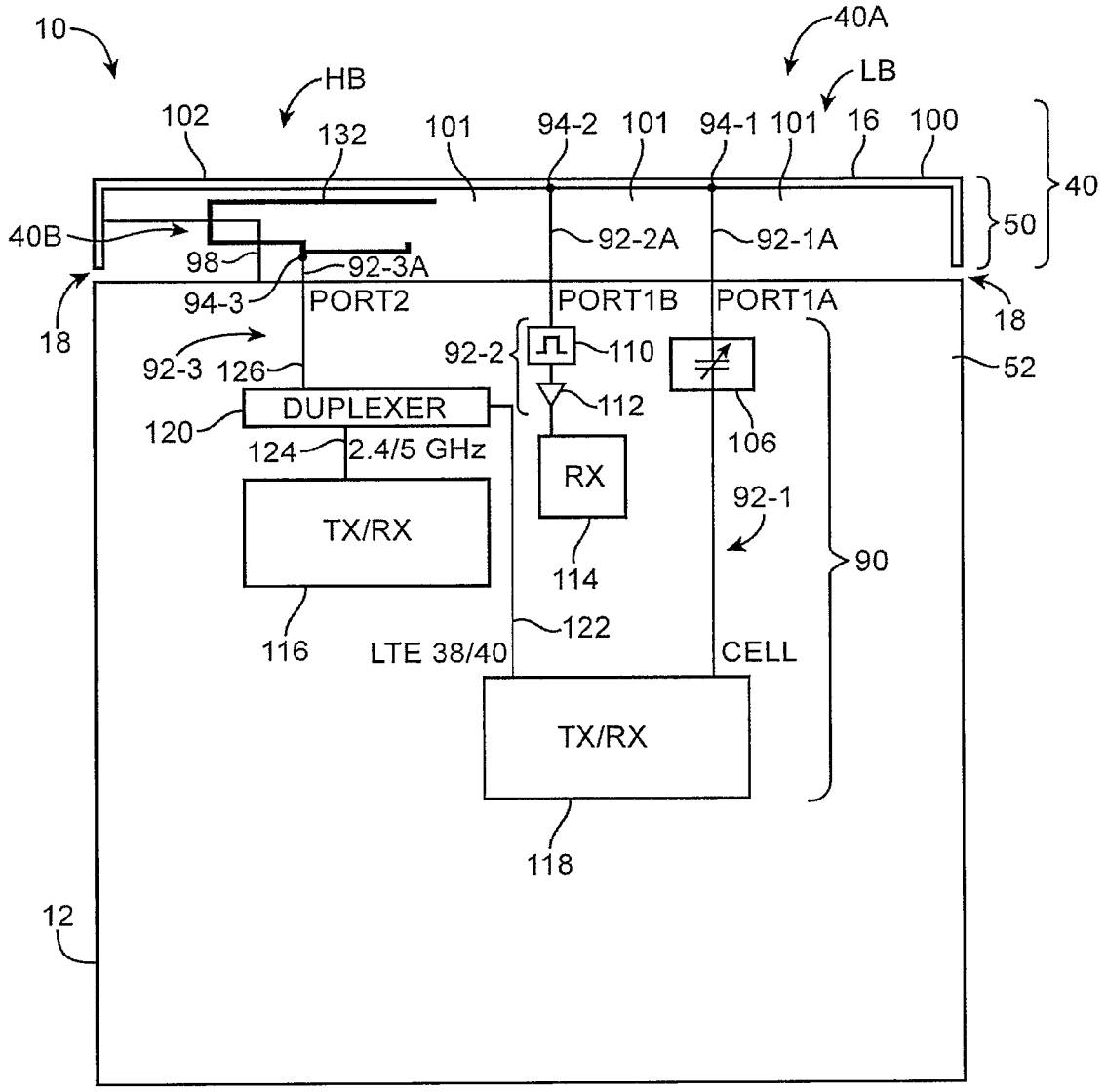
FIG. 5 is a diagram of illustrative electronic device antenna structures having a dual arm inverted-F antenna resonating element with two antenna ports that is formed from a housing structure and having another antenna resonating element coupled to another antenna port in accordance with an embodiment of the present invention.

FIG. 5 is a diagram of an electronic device with illustrative adjustable antenna structures 40. In the illustrative configuration of FIG. 5, electronic device 10 has adjustable antenna structures 40 that are implemented using conductive housing structures in electronic device 10. As shown in FIG. 5, antenna structures 40 include antenna resonating element 132 and antenna resonating element 50. Antenna resonating element 132 may be a monopole antenna resonating element, an inverted-F antenna resonating element, a patch antenna resonating element, a slot antenna resonating element, a loop antenna resonating element, or other suitable antenna resonating element structure. Antenna resonating element 132 and antenna ground 52 may form antenna 40B (e.g., a monopole antenna, an inverted-F antenna, a patch antenna, a loop antenna, a slot antenna, etc.). Antenna resonating element 50 may be a dual arm inverted-F antenna resonating element. Antenna resonating element 50 and antenna ground 52 may form antenna 40A (e.g., a dual arm inverted-F antenna).

Arms 100 and 102 of dual arm inverted-F antenna resonating element 50 may be formed from portions of peripheral conductive housing structures 16. Resonating element arm portion 102 of resonating element 50 in antenna 40A produces an antenna response in a high band (HB) frequency range and resonating element arm portion 100 produces an antenna response in a low band (LB) frequency range. Antenna ground 52 may be formed from sheet metal (e.g., one or more housing midplate members and/or a rear housing wall in housing 12), may be formed from portions of printed circuits, may be formed from conductive device components, or may be formed from other metal portions of device 10.

As described in connection with FIG. 3, antenna structures 40 may have three antenna ports. Port 1A may be coupled to the antenna resonating element arms of dual arm antenna resonating element 50 at a first location along member 16 (see, e.g., path 92-1A, which is coupled to member 16 at terminal 94-1). Port 1B may be coupled to the antenna resonating element arm structures of dual arm antenna resonating element 50 at a second location that is different than the first location (see, e.g., path 92-2A, which is coupled to member 16 at terminal 94-2).

Adjustable capacitor 106 (e.g., a capacitor of the type shown in FIG. 4) may be interposed in path 94-1A and coupled to port 1A for use in tuning antenna structures 40. Global positioning system (GPS) signals may be received using port 1B of antenna 40A. Transmission line path 92-2 may be coupled between port 1B and satellite navigation system receiver 114 (e.g., a Global Positioning System receiver such as satellite navigation system receiver 35 of FIG. 2). Circuitry such as band pass filter 110 and amplifier 112 may, if desired, be interposed within transmission line path 92-2. During operation, satellite navigation system signals may pass from antenna 40A to receiver 114 via filter 110 and amplifier 112.

Antenna resonating element 50 may cover frequencies such as frequencies in a low band (LB) communications band extending from about 700 MHz to 960 MHz and, if desired, a high band (HB) communications band extending from about 1.7 to 2.2 GHz (as examples). Adjustable capacitor 106 is interposed within the feed for antenna 40A and may be used in tuning low band performance in band LB for antenna 40A, so that all desired frequencies between 700 MHz and 960 MHz can be covered.

Port 2 may use signal line 92-3A to feed antenna resonating element 132 of antenna 40B at feed terminal 94-3. Antennas 40A and 40B may be coupled through near-field electromagnetic coupling (i.e., mutual coupling). This allows antenna 40A to be used as a tunable parasitic antenna resonating element that tunes antenna 40B. In particular, the near field coupling between antennas 40A and 40B may be used to allow adjustments to antenna 40A that are made using adjustable circuitry such as adjustable capacitor 106 or other adjustable components (e.g., an adjustable inductor, etc.) at port 1A of antenna 40A or elsewhere in antenna 40A to tune the performance of antenna 40B during operation of antenna 40B. Because antenna 40B can be tuned indirectly in this way, tuning components such as tunable capacitors and other tunable circuitry may be omitted from antenna 40B.

As shown in FIG. 5, for example, antenna 40B may be fed using a transmission line path such as path 92-3 that is free of tunable capacitors or other adjustable circuits. The presence of a component such as a tunable capacitor in path 92-3 could potentially reduce antenna efficiency for antenna 40B. The ability to tune antenna 40B by using antenna 40A as a tunable parasitic can help antenna 40B cover a desired bandwidth using tuning while achieving a desired antenna efficiency by avoiding potentially lossy antenna tuning components in path 92-3 between transceiver 116 and antenna 40B.

Antenna structures 40 may be configured to cover any communications bands of interest. As an example, antenna 40B may be configured to exhibit a resonance at a communications band at 5 GHz (e.g., for handling 5 GHz wireless local area network communications) and a resonance at a communications band at 2.4 GHz. Antenna response in the 2.4 GHz band may be tuned using adjustable capacitor 106 in antenna 40A, which is coupled to antenna 40B through near-field coupling. By tuning the antenna formed from antenna resonating element 132, antenna 40B may be adjusted to cover a range of desired frequencies in a band that extends from a low frequency of about 2.3 GHz to a high frequency of about 2.7 GHz (as an example). This allows antenna 40B to cover both wireless local area network traffic at 2.4 GHz and some of the cellular traffic for device 10.

As shown in the example of FIG. 5, wireless circuitry 90 may include satellite navigation system receiver 114 and radio-frequency transceiver circuitry such as radio-frequency transceiver circuitry 116 and 118. Receiver 114 may be a Global Positioning System receiver or other satellite navigation system receiver (e.g., receiver 35 of FIG. 2). Transceiver 116 may be a wireless local area network transceiver such as radio-frequency transceiver 36 of FIG. 2 that operates in bands such as a 2.4 GHz band and a 5 GHz band. Transceiver 116 may be, for example, an IEEE 802.11 radio-frequency transceiver (sometimes referred to as a WiFi® transceiver). Transceiver 118 may be a cellular transceiver such as cellular transceiver 38 of FIG. 2 that is configured to handle voice and data traffic in one or more cellular bands. Examples of cellular bands that may be covered include a band (e.g., low band LB) ranging from 700 MHz to 960 MHz, a band (e.g., a high band HB) ranging from about 1.7 to 2.2 GHz), and Long Term Evolution (LTE) bands 38 and 40.

Long Term Evolution band 38 is associated with frequencies of about 2.6 GHz. Long Term Evolution band 40 is associated with frequencies of about 2.3 to 2.4 GHz. Port CELL of transceiver 118 may be used to handle cellular signals in band LB (700 MHz to 960 MHz) and, if desired, in band HB (1.7 to 2.2 GHz). Port CELL is coupled to port 1A of antenna structures 40. Port LTE 38/40 of transceiver 118 is used to handle communications in LTE band 38 and LTE band 40. As shown in FIG. 5, port LTE 38/40 of transceiver 118 may be coupled to port 122 of duplexer 120. Port 124 of duplexer 120 may be coupled to the input-output port of transceiver 116, which handles WiFi® signals at 2.4 and 5 GHz.

Duplexer 120 uses frequency multiplexing to route the signals between ports 122 and 124 and shared duplexer port 126. Port 126 is coupled to transmission line path 92-3. With this arrangement, 2.4 GHz and 5 GHz WiFi® signals associated with port 124 of duplexer 120 and transceiver 116 may be routed to and from path 92-3 and LTE band 38/40 signals associated with port 122 of duplexer 120 and port LTE 38/40 of transceiver 118 may be routed to and from path 92-3. Path 92-3 between duplexer 120 and antenna resonating element 132 may be free of adjustable capacitors and other adjustable antenna tuning components. Tuning of antenna 40B can be achieved by tuning antenna 40A using capacitor 106 and using antenna 40A as a tunable parasitic antenna resonating element. With this arrangement, adjustable capacitor 106 can be adjusted to tune the antenna formed from antenna resonating element 132 as needed to handle the 2.4/5 GHz traffic associated with port 124 and the LTE band 38/40 traffic associated with port 122.

Figure 6:
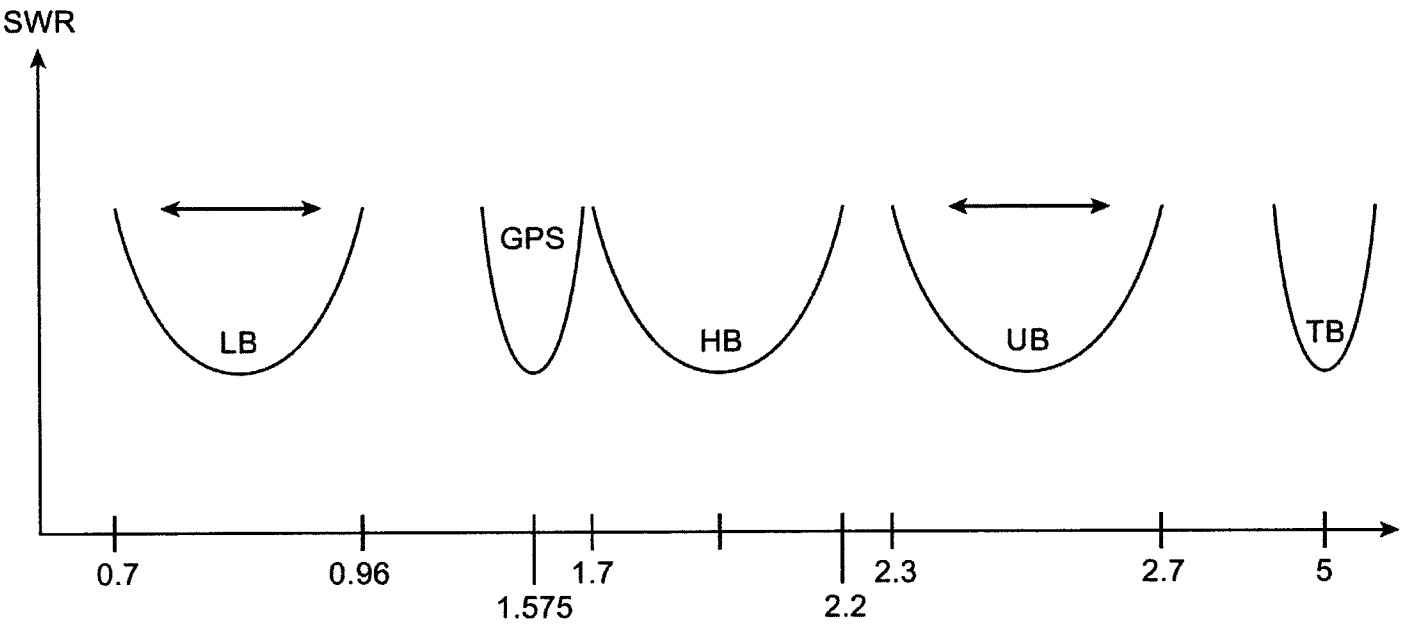
FIG. 6 is a graph of antenna performance as a function of frequency for a tunable antenna of the type shown in FIG. 5 in accordance with an embodiment of the present invention.

FIG. 6 is a graph in which antenna performance (standing wave ratio SWR) has been plotted as a function of operating frequency for a device with antenna structures such as antenna structures 40 of FIG. 5. As shown in FIG. 6, antenna structures 40 (e.g., antenna 40A) may exhibit a resonance at band LB using port 1A. Adjustable capacitor 106 may be adjusted to adjust the position of the LB resonance, thereby covering all frequencies of interest (e.g., all frequencies in a range of about 0.7 GHz to 0.96 GHz, as an example). For example, frequencies near to 0.7 GHz can be covered by setting capacitor 106 to a relatively high capacitance setting (e.g., 10 pF), whereas signals with frequencies near to 0.96 GHz may be covered by setting capacitor 106 to a relatively low capacitance (e.g., 0.4 pF, 4 pF, less than 5 pF, less than 1 pF, 0 pF, or other suitable capacitance value below the high capacitance setting). A number of discrete settings (e.g., six different settings) for capacitor 106 may be used to tune antenna low band response LB across frequencies of interest between 0.7 GHz and 0.96 GHz (as an example). If desired, the antenna resonance associated with band LB may be fixed (i.e., tuning may be omitted).

When using port 1B, antenna structures 40 may exhibit a resonance at a satellite navigation system frequency such as a 1.575 GHz resonance for handling Global Positioning System signals. Band HB (e.g., a cellular band from 1.7 to 2.2 GHz) may be covered by antenna 40A using port 1A (with or without using adjustable capacitor 106 to tune the antenna resonance for antenna 40A that is associated with band HB to cover frequencies of interest).

Using port 2 and antenna 40B, which is formed from antenna resonating element 132 and antenna ground 52, antenna structures 40 may cover communications band UB. Antennas 40B and 40A are coupled by near field coupling, so antenna 40A may be used as a tunable parasitic antenna resonating element that tunes antenna 40B. During operation of antenna 40B, adjustments can be made to antenna 40A using adjustable capacitor 106 that result in antenna resonance tuning of antenna 40B. In this way, adjustable capacitor 106 may be adjusted to tune the position of the UB antenna resonance associated with antenna 40B, thereby ensuring that the UB resonance of antenna 40B can cover all desired frequencies of interest (e.g., frequencies ranging from 2.3 GHz to 2.7 GHz, as an example). For example, adjustable capacitor 106 may be adjusted to ensure that 2.3-2.4 GHz LTE band 40 signals from port 122 can be covered, to ensure that 2.4 GHz WiFi® signals from port 124 can be handled, and to ensure that 2.6 GHz LTE band 38 signals from port 122 can be handled.

During antenna tuning operations for antenna 40A, it is not necessary to tune capacitor 106 over numerous intermediate capacitance values. Rather, capacitor 106 may be adjusted between a relatively small number of settings (e.g., two settings, three settings, etc.).

Figure 7:
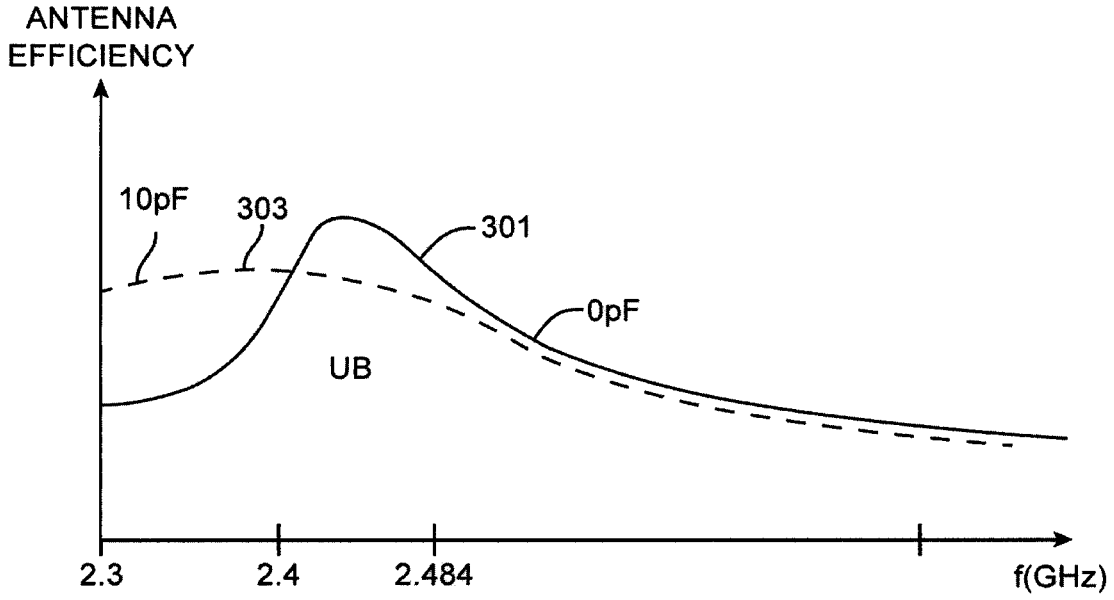
FIG. 7 is a graph of antenna efficiency for an antenna such as a monopole antenna that is being tuned by using a near-field coupled tunable antenna such as a tunable inverted-F antenna in accordance with an embodiment of the present invention.

Consider, as an example, a scenario in which capacitor 106 is adjusted between a maximum value of 10 pF (e.g., a state in which all of capacitors C1 . . . CN are switched into use in capacitor 106) and a minimum value of 0 pF (e.g., a state in which all of capacitors C1 . . . CN are switched out of use in capacitor 106). FIG. 7 is a graph in which antenna efficiency for antenna 40B has been plotted as a function of operating frequency for each of these two states of capacitor 106. When it is desired to operate antenna 40B in a state that covers WiFi® signals from 2.4 to 2.484 GHz, capacitor 106 can be set to exhibit its minimum capacitance (i.e., 0 pF). This causes antenna efficiency to be increased at frequencies between 2.4 to 2.484 GHz, as illustrated by curve 301 of FIG. 7. When it is desired to operate antenna 40B in a state that covers cellular telephone signals (e.g., LTE bands 40 and 38 covering signal frequencies at 2.3-2.4 GHz and 2.570-2.618 GHz, respectively), capacitor 106 can be set to exhibit its minimum capacitance (e.g., 0 pF). This causes antenna efficiency to expand and increase below 2.4 GHz to help cover these bands, as illustrated by curve 303 of FIG. 7.

As shown in FIG. 6, band TB (e.g., a band at 5 GHz for handling 5 GH WiFi® signals from port 124) may be covered using antenna 40B, which is formed from antenna resonating element 132 and antenna ground 52. Band TB may, for example, be covered by antenna 40B without tuning capacitor 106 in antenna 40A between multiple different settings.

The foregoing is merely illustrative of the principles of this invention and various modifications can be made by those skilled in the art without departing from the scope and spirit of the invention.

What is claimed is:

1. Electronic device antenna structures, comprising:

an antenna ground;

a first antenna resonating element that forms a first antenna with the antenna ground and that is configured to resonate in a first frequency band;

a second antenna resonating element that forms a second antenna with the antenna ground and that is configured to resonate in a second frequency band that is different from the first frequency band, wherein the second antenna is near-field coupled to the first antenna and the second antenna serves as a tunable parasitic antenna resonating element for the first antenna; and an adjustable component coupled to the second antenna resonating element, the adjustable component being configured to tune the first antenna resonating element within the first frequency band.

2. The electronic device antenna structures defined in claim 1 wherein the adjustable component comprises an adjustable capacitor.

3. The electronic device antenna structures defined in claim 2 wherein the second antenna has at least one port and wherein the adjustable capacitor is coupled to the port.

4. The electronic device antenna structures defined in claim 3 wherein the first antenna has a port that is free of coupled adjustable antenna tuning components.

5. The electronic device antenna structures defined in claim 1 wherein the second antenna comprises an inverted-F antenna.

6. The electronic device antenna structures defined in claim 5 wherein the second antenna resonating element comprises a peripheral conductive electronic device housing member, first and second dielectric gaps are formed in the peripheral conductive electronic device housing member at opposing external surfaces of the electronic device, and the second antenna resonating element comprises a segment of the peripheral conductive electronic device housing member that extends between the first and second dielectric gaps.

7. The electronic device antenna structures defined in claim 1 wherein the second antenna has first and second ports, the adjustable component is coupled to the first port, the adjustable component is configured to tune the second antenna resonating element during operation of the second antenna, and the adjustable component is configured to tune the first antenna resonating element during operation of the first antenna through a third port.

8. The electronic device antenna structures defined in claim 1, further comprising:

a first radio-frequency transmission line structure coupled to the first antenna resonating element, wherein the first radio-frequency transmission line structure conveys radio-frequency signals in the first frequency band;

a second radio-frequency transmission line structure coupled to the second antenna resonating element through the adjustable component, wherein the second radio-frequency transmission line structure conveys radio-frequency signals in the second frequency band; and a third radio-frequency transmission line structure coupled to the second antenna resonating element.

9. The electronic device antenna structures defined in claim 8, wherein the third radio-frequency transmission line structure conveys radio-frequency signals in a third frequency band that is different from the first and second frequency bands.

10. The electronic device antenna structures defined in claim 1, wherein the adjustable component is configured to concurrently tune the second antenna resonating element within the second frequency band and the first antenna resonating element within the first frequency band.

11. An electronic device, comprising:

antenna structures having first, second, and third antenna ports, wherein the antenna structures include an antenna ground, an inverted-F antenna resonating element that forms an inverted-F antenna with the antenna ground, and an additional antenna resonating element that forms an additional antenna with the antenna ground, wherein the first and second antenna ports are coupled to different locations on the inverted-F antenna resonating element and wherein the third antenna port is coupled to the additional antenna;

wireless circuitry that is coupled to the first, second, and third antenna ports through respective first, second, and third transmission line structures; and a tunable component coupled to the first port, wherein the inverted-F antenna serves as a tunable parasitic antenna resonating element for the additional antenna during transmission and reception of wireless signals through the third antenna port using the wireless circuitry.

12. The electronic device defined in claim 11 wherein the tunable component comprises an adjustable capacitor.

13. The electronic device defined in claim 12 wherein the inverted-F antenna is configured to cover cellular telephone frequencies from 0.7 to 0.96 GHz by tuning a low band antenna resonance of the inverted-F antenna using the adjustable capacitor.

14. The electronic device defined in claim 13 wherein the wireless circuitry comprises a satellite navigation system receiver coupled to the second port.

15. The electronic device defined in claim 14 wherein the inverted-F antenna is configured to handle cellular telephone frequencies in a band between 1.7 and 2.2 GHz.

16. The electronic device defined in claim 15 wherein the additional antenna is configured to handle signal frequencies between 2.3 and 2.7 GHz.

17. The electronic device defined in claim 16 wherein the adjustable capacitor is configured to exhibit a first capacitance when the additional antenna is handling wireless local area network signals and is configured to exhibit a second capacitance when the additional antenna is handling cellular telephone signals.

18. The electronic device defined in claim 17 wherein the third port is free of adjustable components and wherein the additional antenna has a configuration such that the antenna resonates at the frequencies between 2.3 and 2.7 GHz and at 5 GHz.

19. An electronic device, comprising:

radio-frequency transceiver circuitry configured to handle wireless local area network signals, satellite navigation system signals, and cellular telephone signals;

a first antenna;

a second antenna that is coupled to the radio-frequency transceiver circuitry using a transmission line without adjustable antenna tuning components, wherein the first antenna is near-field coupled to the second antenna and serves as a tunable parasitic antenna resonating element for the second antenna, the first and second antennas being configured to concurrently handle the wireless local area network signals and the cellular telephone signals; and an adjustable capacitor coupled between the radio-frequency transceiver circuitry and the first antenna, wherein the adjustable capacitor is configured to tune the first antenna to cover at least one cellular telephone band of the cellular telephone signals and the adjustable capacitor is configured to adjust the tunable parasitic antenna resonating element to tune the second antenna.

20. The electronic device defined in claim 19 further comprising a peripheral conductive housing member, wherein the first antenna comprises an inverted-F antenna and wherein a portion of the peripheral conductive housing member forms a portion of the inverted-F antenna.

21. The electronic device defined in claim 19 wherein the second antenna comprises a monopole antenna.

22. The electronic device defined in claim 19 further comprising a conductive structure that serves as antenna ground for the first and second antennas.

* * * * *